US009126739B2

(12) United States Patent
Chao-Ming

(10) Patent No.: US 9,126,739 B2
(45) Date of Patent: Sep. 8, 2015

(54) DISPLAY BOX FOR SOCKETS

(71) Applicant: Chen Chao-Ming, Taichung (TW)

(72) Inventor: Chen Chao-Ming, Taichung (TW)

( * ) Notice: Subject to any disclaimer, the term of this patent is extended or adjusted under 35 U.S.C. 154(b) by 39 days.

(21) Appl. No.: 14/140,601

(22) Filed: Dec. 26, 2013

(65) Prior Publication Data

US 2015/0183573 A1 Jul. 2, 2015

(51) Int. Cl.

| | |
|---|---|
| ***B65D 85/28*** | (2006.01) |
| ***B65D 85/02*** | (2006.01) |
| ***B65D 1/36*** | (2006.01) |

(52) U.S. Cl.

CPC . *B65D 85/02* (2013.01); *B65D 1/36* (2013.01)

(58) Field of Classification Search

CPC .... B65D 71/50; B65D 25/2802; B65D 85/02; B65D 1/36; B25H 3/04; B25H 3/003

USPC ..... 206/372–379, 493, 806; 211/69, 70.6

See application file for complete search history.

(56) References Cited

U.S. PATENT DOCUMENTS

| | | | | |
|---|---|---|---|---|
| 6,092,656 | A * | 7/2000 | Ernst | 206/378 |
| 6,508,360 | B1 * | 1/2003 | Chen | 206/378 |
| 8,205,758 | B2 * | 6/2012 | Shih | 211/70.6 |
| 8,307,980 | B1 * | 11/2012 | Kao | 206/378 |
| 8,381,905 | B1 * | 2/2013 | Kao | 206/378 |
| 8,550,244 | B1 * | 10/2013 | Ou | 206/378 |
| 8,556,075 | B1 * | 10/2013 | Ou | 206/378 |
| 2001/0010291 | A1 * | 8/2001 | Hu | 206/377 |
| 2010/0170817 | A1 * | 7/2010 | Wu | 206/378 |

FOREIGN PATENT DOCUMENTS

TW M454911 U 6/2013

* cited by examiner

*Primary Examiner* — Luan K Bui

(74) *Attorney, Agent, or Firm* — Alan D. Kamrath; Kamrath IP Lawfirm, P.A.

(57) ABSTRACT

A display box for sockets contains a body and a limiting frame. The body includes a plurality of receiving chambers arranged on a front surface thereof so as to accommodate socket tools and includes an accommodation portion defined on a back surface thereof and communicating with the plurality of receiving chambers. The limiting frame is fixed in the accommodation portion of the body by a fixing structure and includes a vertical rod, the vertical rod has a plurality of horizontal posts extending outwardly therefrom so as to insert into the socket tools.

9 Claims, 12 Drawing Sheets

DISPLAY BOX FOR SOCKETS

FIELD OF THE INVENTION

The present invention relates to a display box for sockets which prevents the sockets from being stolen and enhances aesthetics appearance.

BACKGROUND OF THE INVENTION

Referring to FIGS. 1 and 2, a conventional tool hanging card 10 is disclosed in TW Publication No. M454911 and contains a body 11, two connecting members 12, two first screwing elements 13, two second screwing elements 14, and a coupling set 15. The body 11 includes a first portion 111, a second connection portion 112, two coupling portions 113 defined on two sides of the second connection portion 112, a plurality of locking blocks 114 arranged on each coupling portion 113, two first joining portions 115 formed on two bottom ends of two sides of the first portion 111, and two second joining portions 116 arranged on two distal ends of two sides of the second portion 112. Each connecting member 12 has plural fixing elements 121 corresponding to the plurality of locking blocks 114 of the body 11 so as to fit plural sockets 20, a third joining portion 122 defined on a first end thereof and connecting with each first joining portion 115 by means of each first screwing element 13 which is a screw bolt. Each connecting member 12 also has a fourth joining portion 123 formed on a second end thereof and connecting with each second joining portion 116 by means of each second screwing element 1 which is a screw bolt. An accommodation space is defined by the two connecting members 12 and the body 11 so as to receive the plural sockets 20. The second connection portion 112 of the body 11 has plural through holes 117 formed thereon, and between the third joining portion 122 and the fourth joining portion 123 of each connecting member 12 is defined a recessed portion 124 for inserting a tying band 15, such that the body 11 is connected with each connecting member 12 securely, thus holding the plural sockets 20 by ways of the tool hanging card 10.

However, the tool hanging card 10 has the following disadvantages:

1. After the body 11 connects with the two connecting members 12 by using the two first screwing elements 13 and the two second screwing elements 14, the two connecting members 12 and the coupling set 15 expose outside the tool hanging card 10, thus influencing aesthetics appearance.

2. After the body 11 connects with the two connecting members 12 by using the two first screwing elements 13 and the two second screwing elements 14, the coupling set 15 ties the body 11 and the two connecting members 12 so that the plural sockets 20 are limited in the accommodation space, thus removing the plural sockets 20 troublesomely.

The present invention has arisen to mitigate and/or obviate the afore-described disadvantages.

SUMMARY OF THE INVENTION

The primary object of the present invention is to provide a display box for sockets which prevents the sockets from being stolen.

Further object of the present invention is to provide a display box for sockets in which a limiting frame is hidden on a back surface of a body so as to achieve aesthetics appearance.

Another object of the present invention is to provide a display box for sockets in which a first flexible retaining portion and a second flexible retaining portion of the limiting frame are cut, and then the limiting frame is pulled out of the body so that plural first horizontal posts and plural second horizontal posts of the limiting frame are separated from first socket tools and second socket tools, thereby removing the first socket tools and the second socket tools from the body easily.

To obtain the above objectives, a display box for sockets provided by the present invention contains: a body and a limiting frame.

The body includes a plurality of receiving chambers arranged on a front surface thereof so as to accommodate socket tools and includes an accommodation portion defined on a back surface thereof and communicating with the plurality of receiving chambers. The limiting frame is fixed in the accommodation portion of the body by a fixing structure and includes a vertical rod, the vertical rod has a plurality of horizontal posts extending outwardly therefrom so as to insert into the socket tools.

DETAILED DESCRIPTION OF THE PREFERRED EMBODIMENTS

Figure 1:
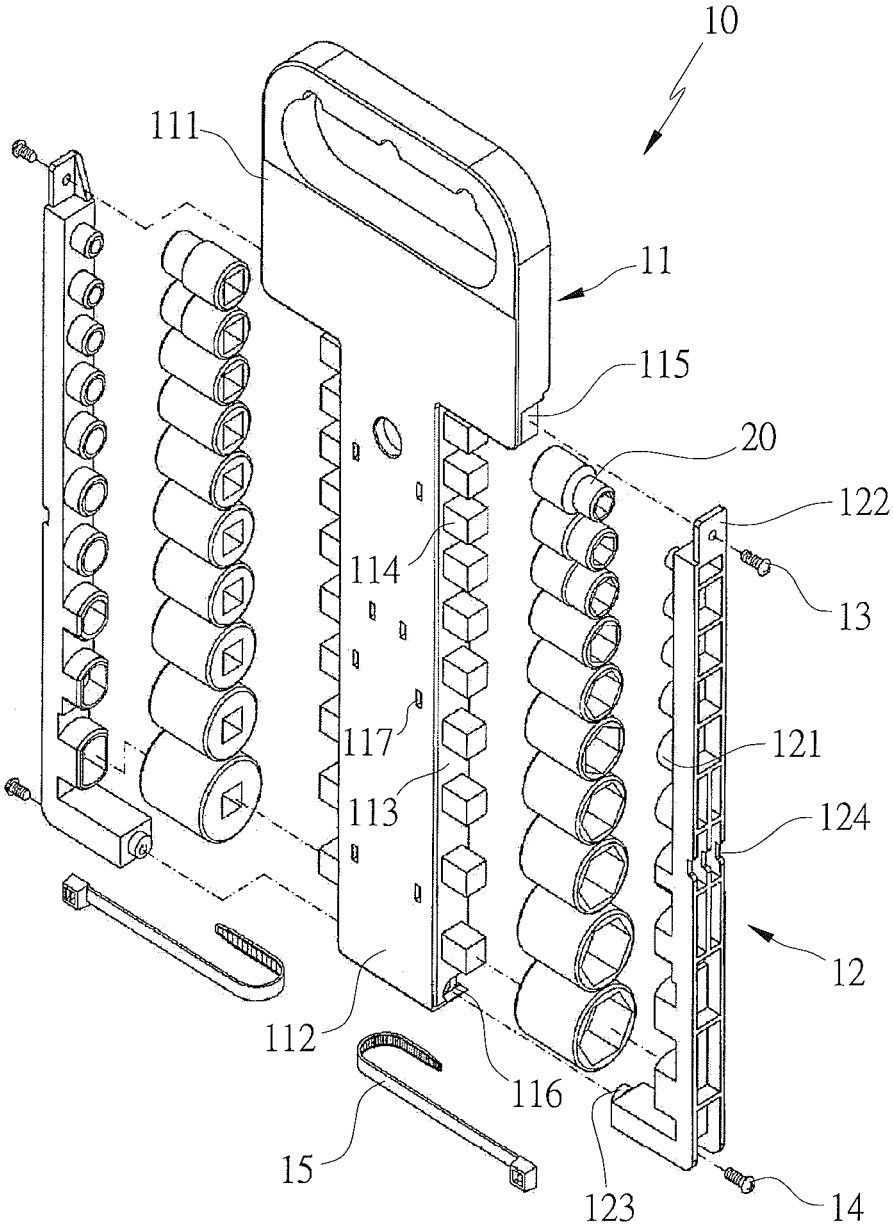
F I G . 1 PRIOR ART
FIG. 1 is a perspective view of a conventional tool hanging card.
Figure 2:
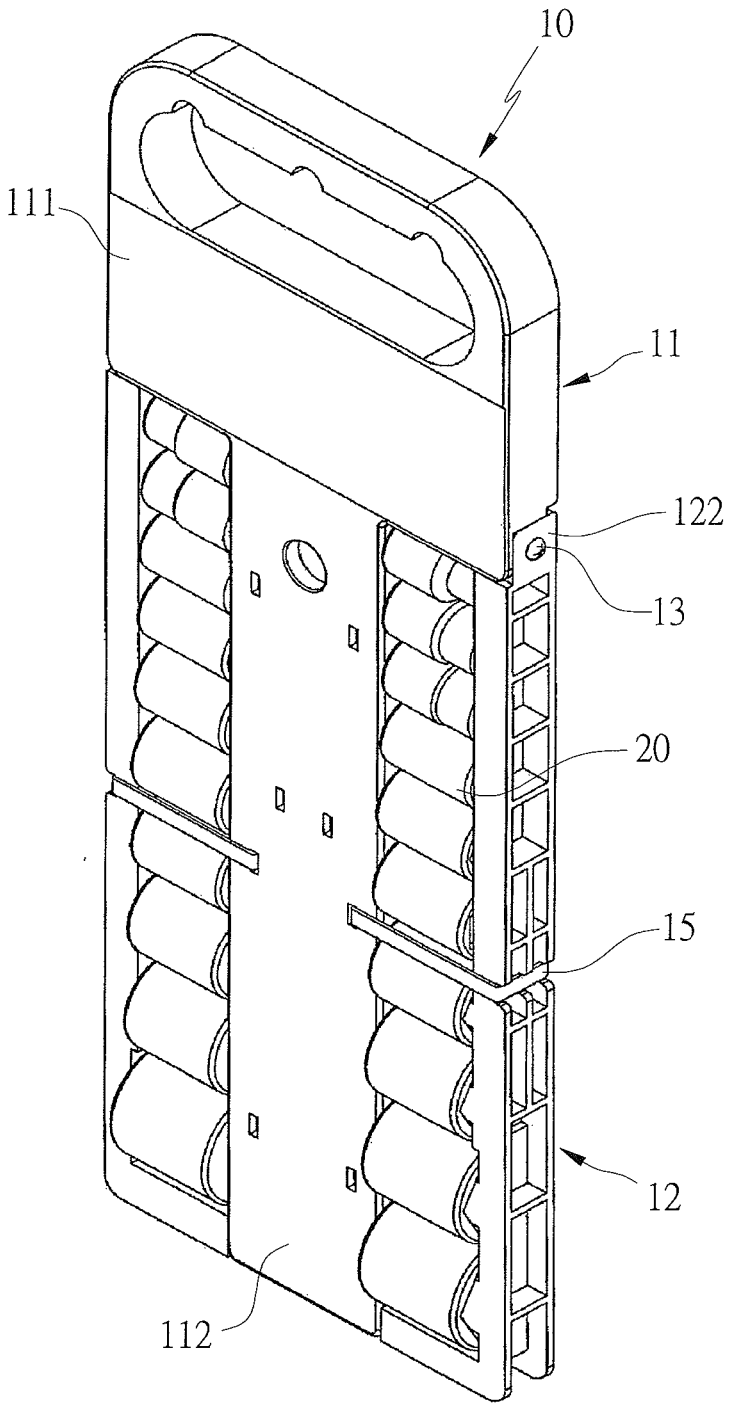
FIG. 2 PRIOR ART
FIG. 2 is another perspective view of the conventional tool hanging card.
Figure 3:
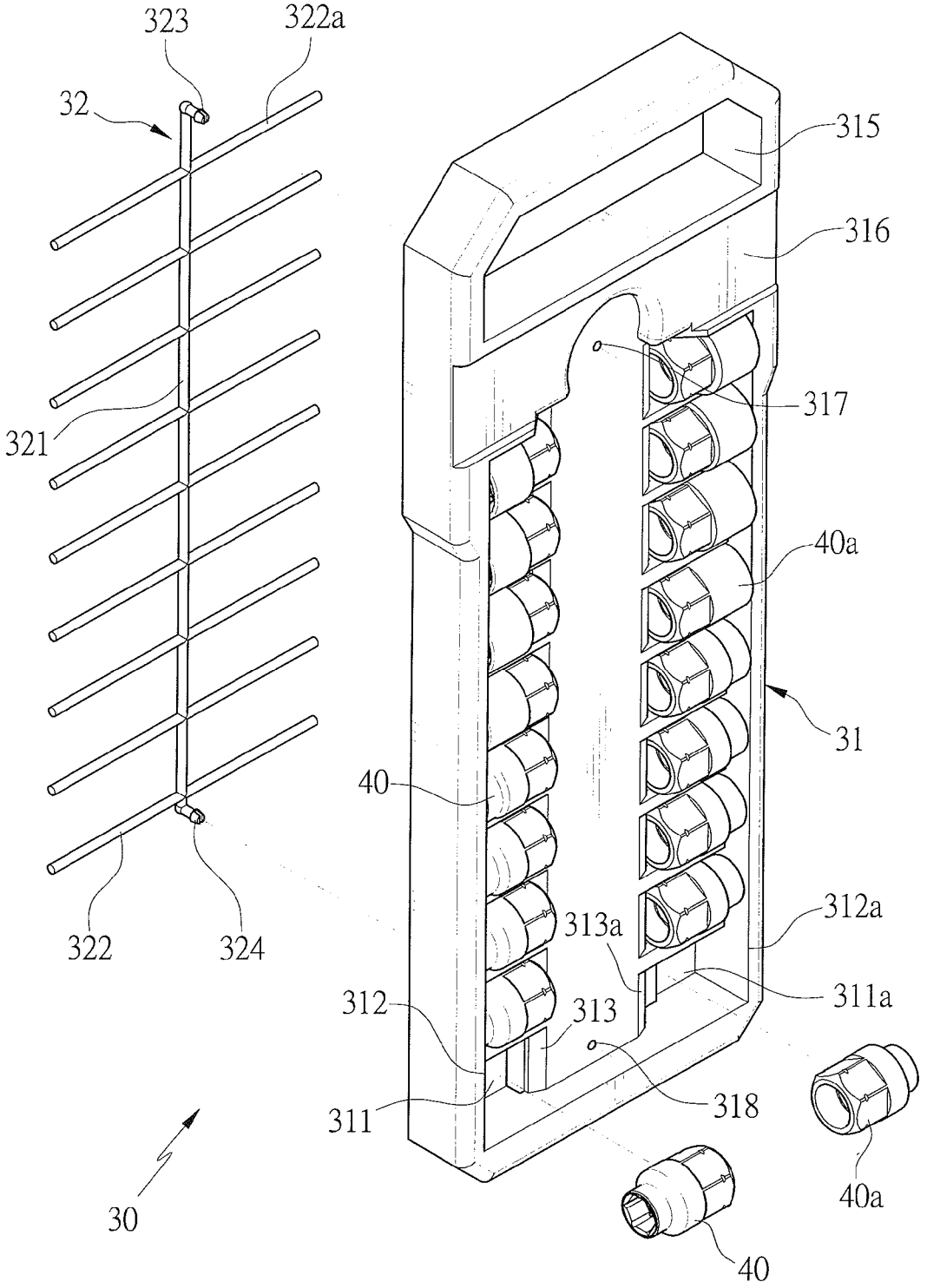
FIG. 3 is a perspective view showing the exploded components of a display box for socket tools according to a first embodiment of the present invention.
Figure 4:
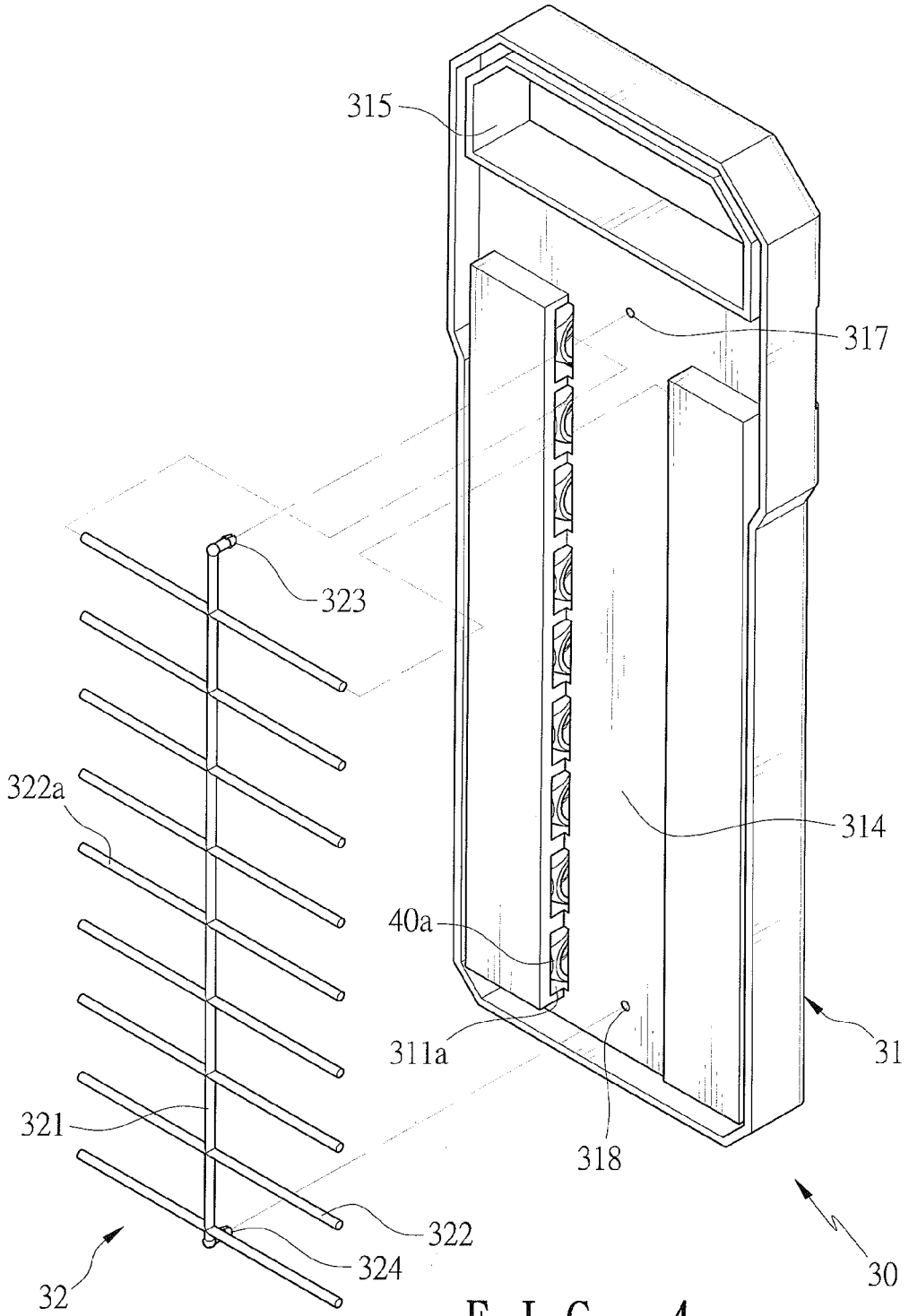
FIG. 4 is another perspective view showing the exploded components of the display box for the socket tools according to the first embodiment of the present invention.
Figure 5:
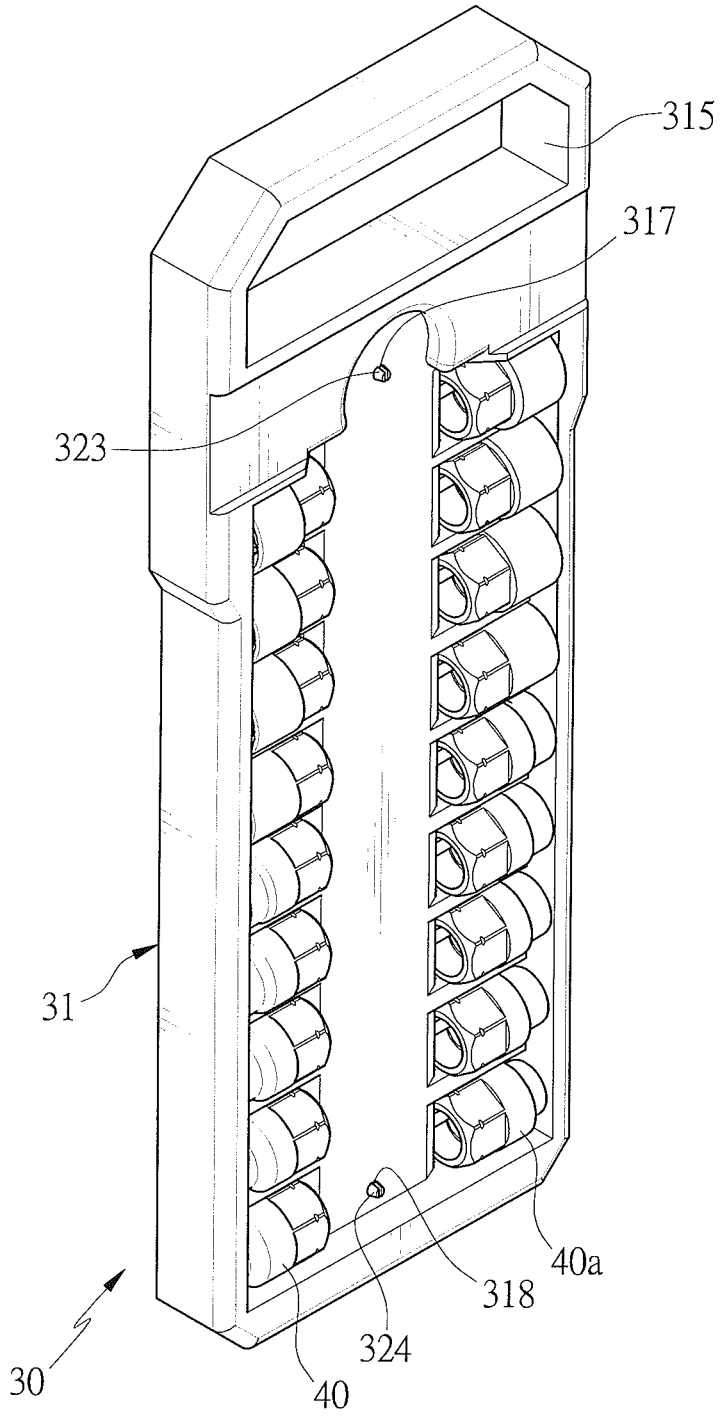
FIG. 5 is a perspective view showing the assembly of the display box for the socket tools according to the first embodiment of the present invention.
Figure 6:
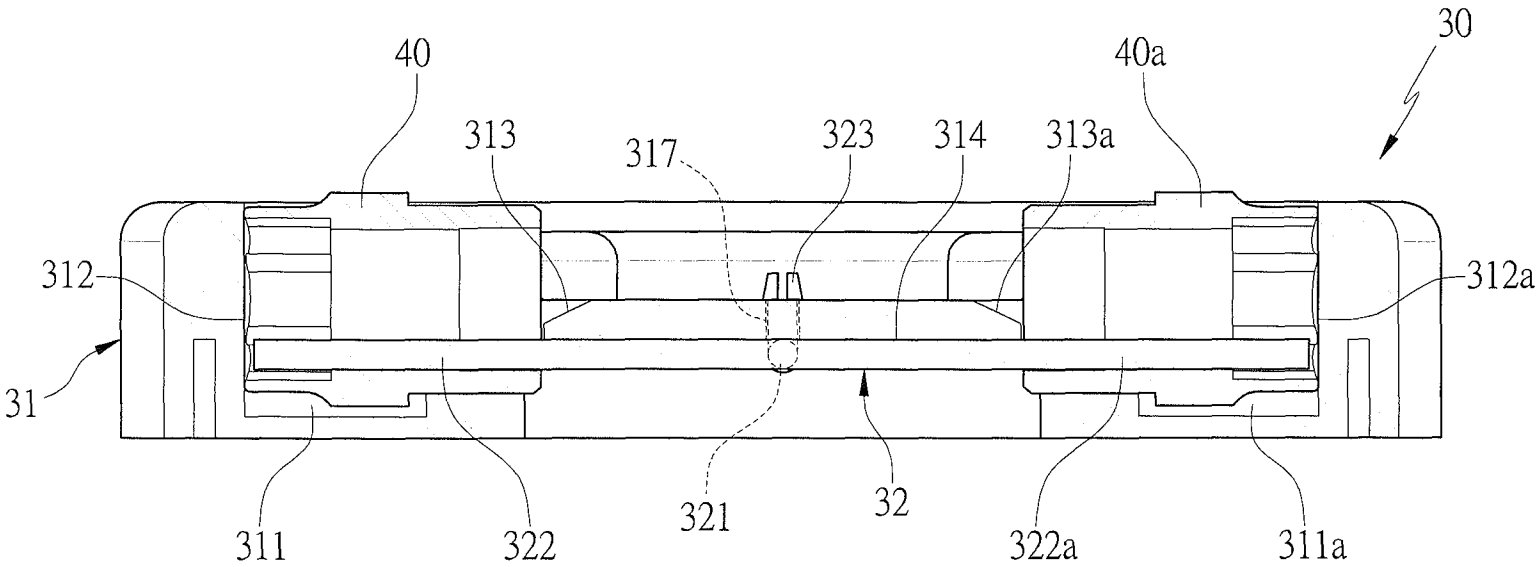
FIG. 6 is a cross sectional view showing the assembly of the display box for the socket tools according to the first embodiment of the present invention.

With reference to FIGS. 3 and 4, a display box 30 for sockets according to a first embodiment of the present invention comprises: a body 31 and a limiting frame 32. The body 31 includes a plurality of receiving chambers arranged on a front surface thereof so as to accommodate socket tools; in this embodiment, the body 31 includes plural first receiving chambers 311 arranged on a first side of the front surface thereof so as to accommodate first socket tools 40 and plural second receiving chambers 311*a* defined on a second side of the front surface thereof so as to accommodate second socket tools 40*a*, wherein each first receiving chamber 311 has a first side fence 312 formed on an outer side end thereof, and each second receiving chamber 311*a* has a second side fence 312*a* formed on an outer side end thereof; in this embodiment, the first side fence 312 and the second side fence 312*a* extend outwardly to cover outer end portions of each first socket tool 40 and each second socket tool 40*a*; and each first receiving chamber 311 has a first beveled face 313 defined on an inner side end thereof, each second receiving chamber 311*a* has a second beveled face 313*a* formed on an inner side end thereof, such that inner end portions of each first socket tool 40 and each second socket tool 40*a* are moved easily so that each first socket tool 40 and each second socket tool 40*a* remove from the display box 30 conveniently; the body 31 also includes an accommodation portion 314 defined on a central portion of a back surface thereof, wherein a first side of the accommodation portion 314 communicates with the inner side end of each first receiving chamber 311, and a second end of the accommodation portion 314 communicates with the inner side end of each second receiving chamber 311*a*. To hang the display box 30 conveniently, the body 31 further includes a hanging portion 315 defined on a top end thereof and being a through slot, a marking portion 316 formed on a predetermined position of the front surface thereof so as to mark at least one of trademark patterns, letters and sizes of each first socket tool 40 and each second socket tool 40*a* thereon; the limiting frame 32 is fixed in the accommodation portion 314 of the body 31 and includes a vertical rod 321 having a plurality of horizontal posts extending outwardly from the vertical rod 321. In this embodiment, the limiting frame 32 is made of flexibly plastic material and includes plural first horizontal posts 322 extending outwardly from a first side thereof corresponding to the plural first receiving chambers 311 of the limiting frame 32, and the limiting frame 32 also includes plural second horizontal posts 322*a* extending outwardly from a second side thereof corresponding to the plural second receiving chambers 311*a* of the limiting frame 32; between the limiting frame 32 and the body 31 is defined a fixing structure for fixing the limiting frame 32 in the accommodation portion 314 of the body 31, and the fixing structure includes at least one flexible retaining portion arranged on the vertical rod 321 of the limiting frame 32, the body 31 includes at least one locking notch for inserting and fixing the at least one flexible retaining portion of the limiting frame 32; in this embodiment, the vertical rod 321 of the limiting frame 32 has a first flexible retaining portion 323 extending outwardly from a first end thereof and a second flexible retaining portion 324 extending outwardly from a second end thereof, and the body 31 further includes a first locking notch 317 and a second locking notch 318 so as to insert and fix the first flexible retaining portion 323 and the second flexible retaining portion 324 of the limiting frame 32. As shown in FIGS. 5 and 6, the body 31 is connected with the limiting frame 32, and since the limiting frame 32 is made of flexibly plastic material, the plural first horizontal posts 322 and the plural second horizontal posts 322*a* of the limiting frame 32 bend and insert into the first socket tools 40 and the second socket tools 40*a*, and the first flexible retaining portion 323 and the second flexible retaining portion 324 of the limiting frame 32 are inserted and fixed in the first locking notch 317 and the second locking notch 318 of the body 31 so that the limiting frame 32 is mounted in the accommodation portion 314 of the body 31, and the display box 30 holds the first socket tools 40 and the second socket tools 40*a* and is hung by ways of the hanging portion 315 of the body 31, thus displaying the socket tools. When the display box 30 is displayed for sale, and a theft is desired to steal the first socket tools 40 and the second socket tools 40*a* by pulling inner end portions of the first socket tools 40 and the second socket tools 40*a*, due to the plural first horizontal posts 322 and the plural second horizontal posts 322*a* of the limiting frame 32 are pressed by the accommodation portion 314 of the body 31, and contacting positions of the inner end portions of the first socket tools 40 and the plural first horizontal post 322 are close to connecting portions of the vertical rod 321 and the plural first horizontal posts 322, and contacting positions of the inner end portions of the second socket tools 40*a* and the plural second horizontal post 322*a* are close to connecting portions of the vertical rod 321 and the plural second horizontal posts 322*a*, so the plural first horizontal posts 322 and the plural second horizontal posts 322*a* of the limiting frame 32 have strong reinforcement to prevent from deformation when they are pulled by the inner end portions of the first socket tools 40 and the second socket tools 40*a*, thus avoiding the first socket tools 40 and the second socket tools 40*a* being removed from the display box 30. In addition, the first side fence 312 and the second side fence 312*a* of the body 31 cover the outer end portions of each first socket tool 40 and each second socket tool 40*a* so as to prevent the outer end portions of each first socket tool 40 and each second socket tool 40*a* from being pulled outwardly, thus obtaining anti-theft purpose. Thereby, the first socket tools 40 and the second socket tools 40*a* are accommodated in the plural first receiving chambers 311 and the plural second receiving chambers 311*a* of the body 31 by using the plural first horizontal posts 322 and the plural second horizontal posts 322*a* of the limiting frame 32, so not only each first socket tool 40 and each second socket tool 40*a* will not be stolen, but also the limiting frame 32 is hidden on the back surface of the body 31 so as to achieve aesthetics appearance.

Figure 7:
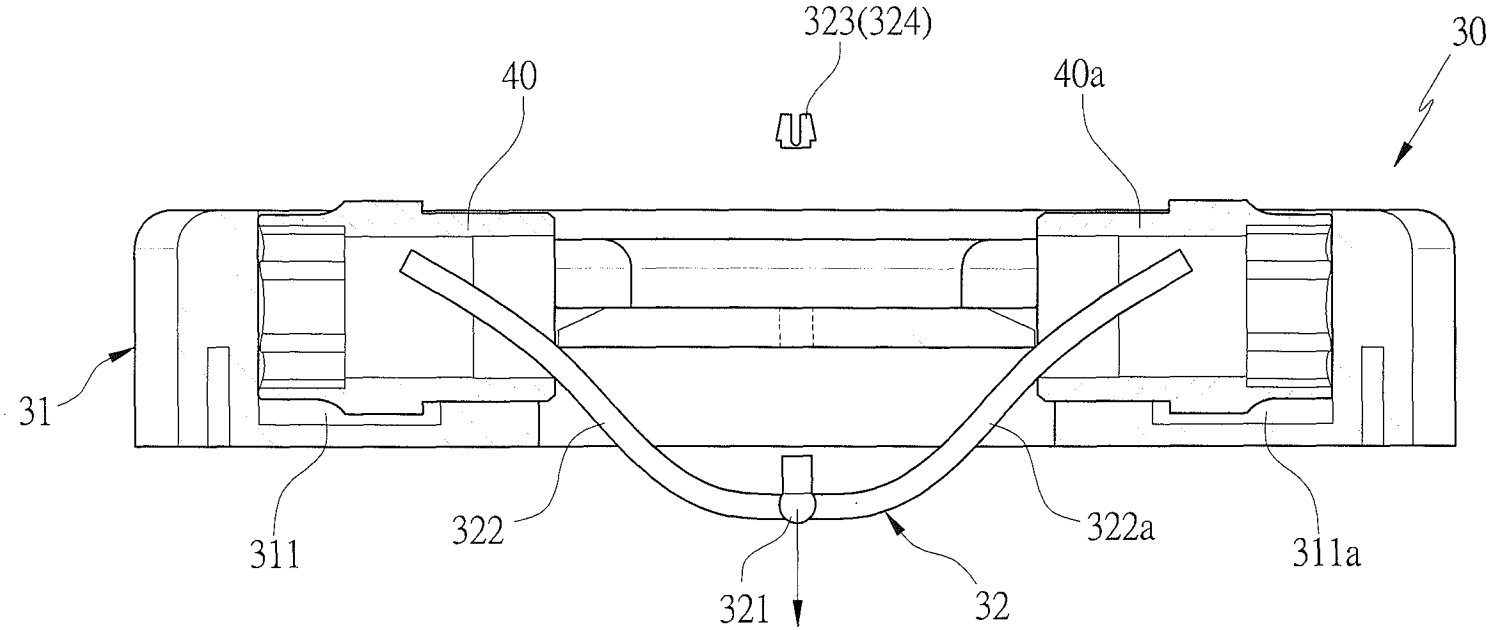
FIG. 7 is a cross sectional view showing the operation of the display box for the socket tools according to the first embodiment of the present invention.

As illustrated in FIG. 7, as intending to remove each first socket tool 40 and each second socket tool 40*a*, the first flexible retaining portion 323 and the second flexible retaining portion 324 of the limiting frame 32 are cut, and then the limiting frame 32 is pulled out of the body 31 so that the plural first horizontal posts 322 and the plural second horizontal posts 322*a* of the limiting frame 32 are separated from the first socket tools 40 and the second socket tools 40*a*, thereby removing the first socket tools 40 and the second socket tools 40*a* from the body 31 easily.

Figure 8:
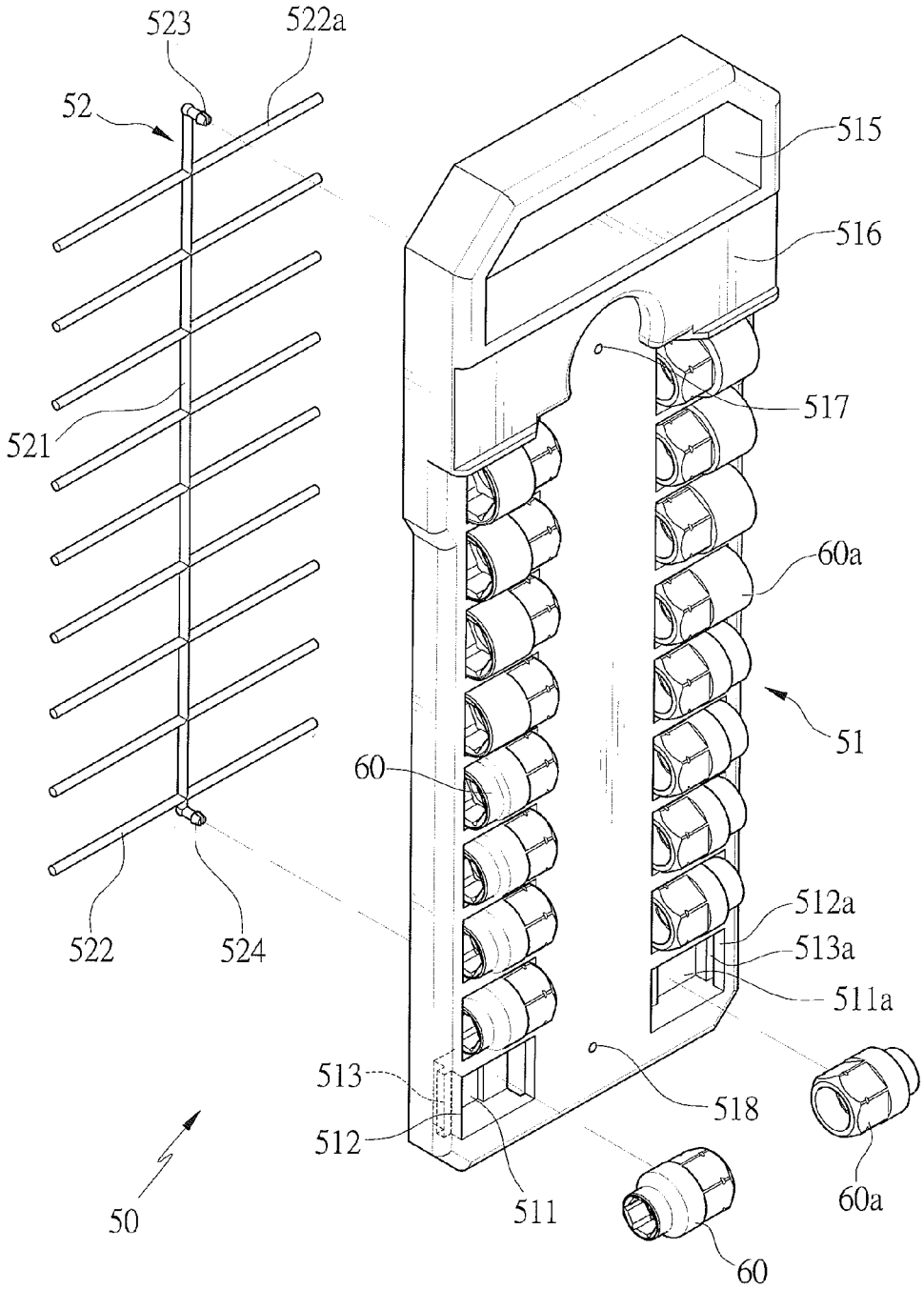
FIG. 8 is a perspective view showing the exploded components of a display box for socket tools according to a second embodiment of the present invention.
Figure 9:
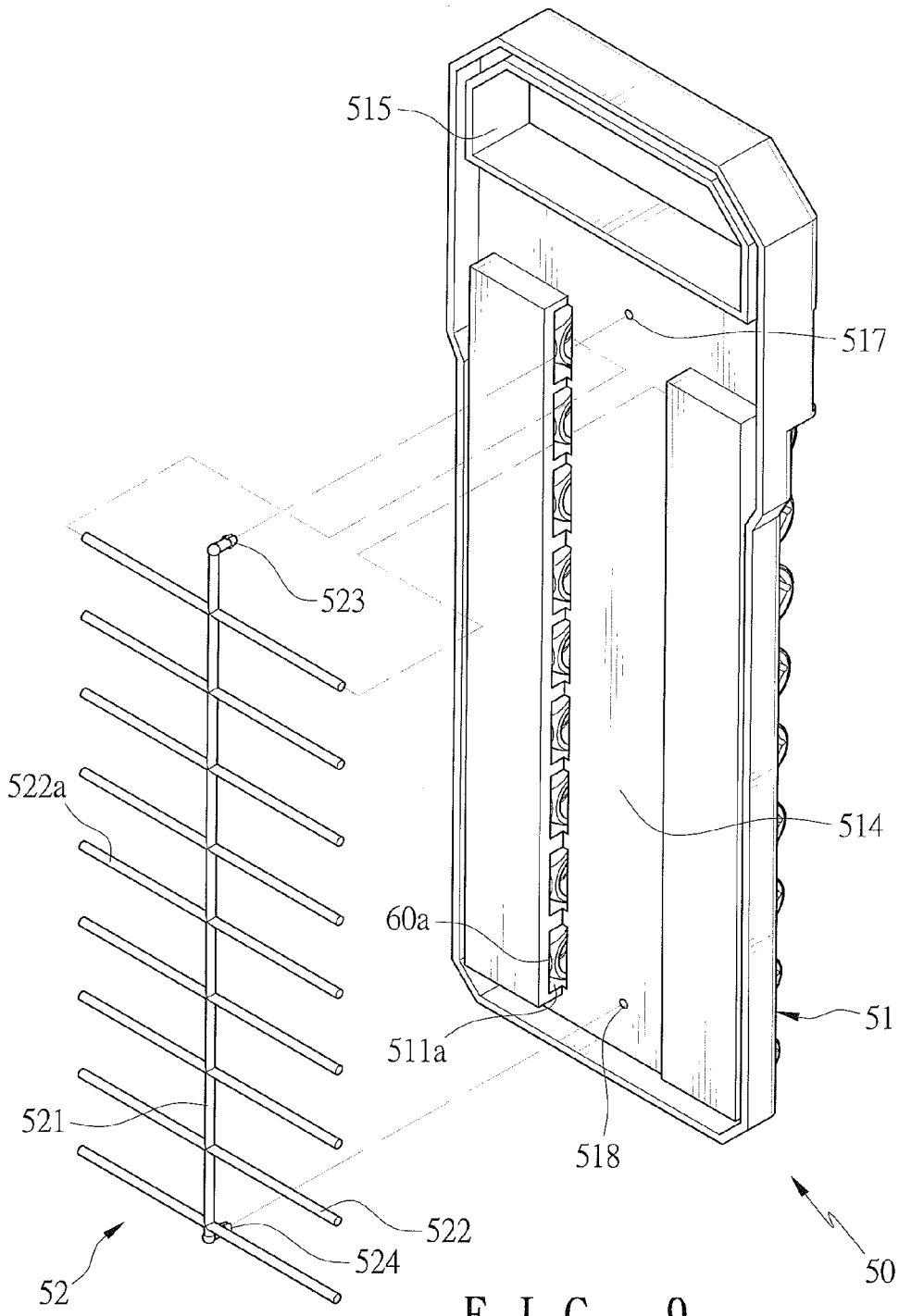
FIG. 9 is another perspective view showing the exploded components of the display box for the socket tools according to the second embodiment of the present invention.
Figure 10:
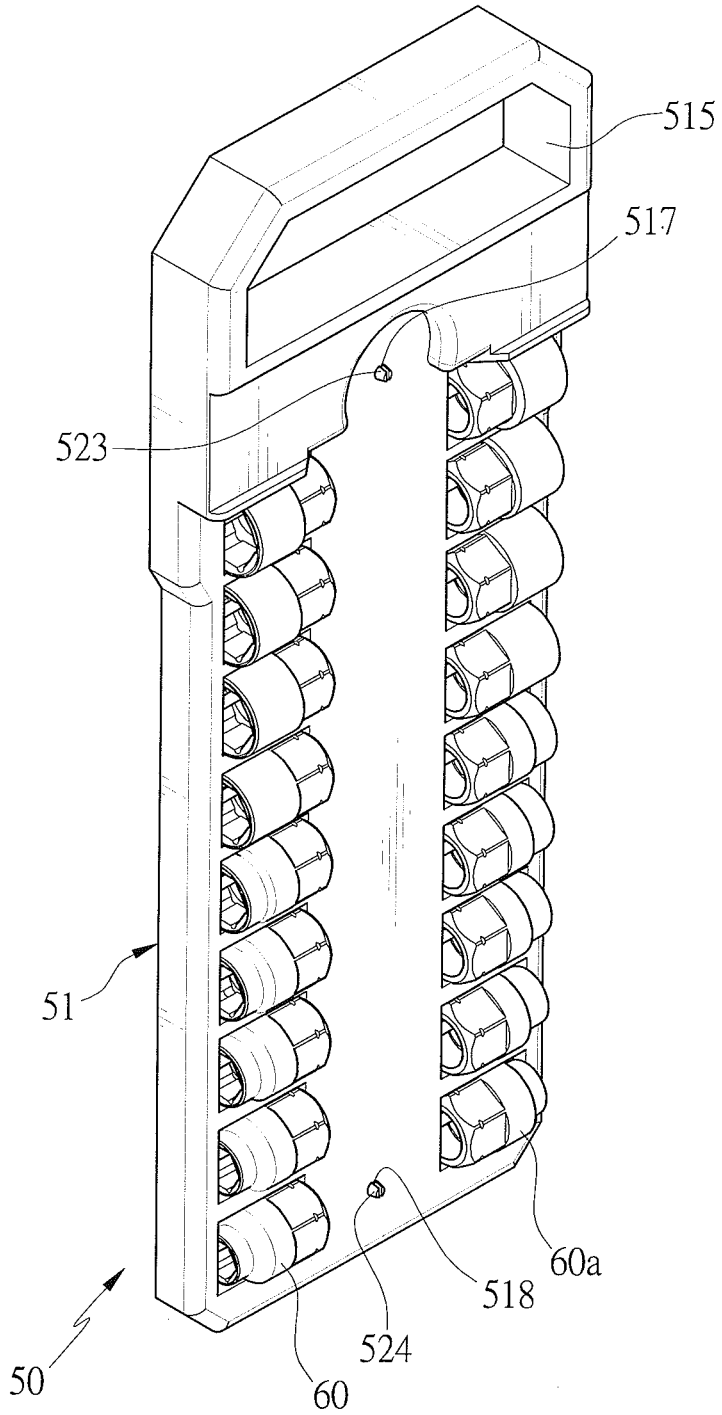
FIG. 10 is a perspective view showing the assembly of the display box for the socket tools according to the second embodiment of the present invention.
Figure 11:
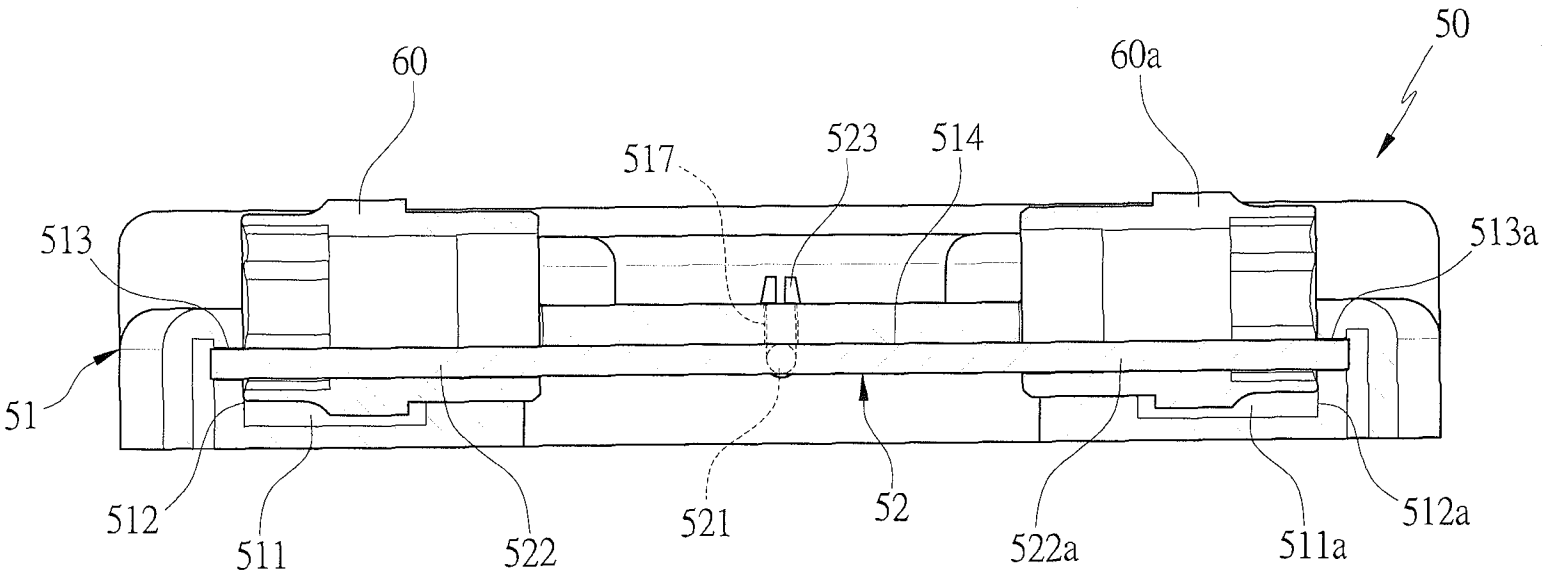
FIG. 11 is a cross sectional view showing the assembly of the display box for the socket tools according to the second embodiment of the present invention.

With reference to FIGS. 8 and 9, a display box 50 for sockets according to a second embodiment of the present invention comprises: a body 51 and a limiting frame 52. The body 51 includes plural first receiving chambers 511 arranged on a first side of the front surface thereof so as to accommodate first socket tools 60 and plural second receiving chambers 511*a* defined on a second side of the front surface thereof so as to accommodate second socket tools 60*a*, wherein each first receiving chamber 511 has a first side fence 512 formed on an outer side end thereof, and each second receiving chamber 511*a* has a second side fence 512*a* formed on an outer side end thereof; the first side fence 512 has a first stopping portion 513, and the second side fence 512*a* has a second stopping portion 513*a*; in this embodiment, each of the first stopping portion 513 and the second stopping portion 513*a* is a recess; the body 51 also includes an accommodation portion 514 defined on a central portion of a back surface thereof, wherein a first side of the accommodation portion 514 communicates with an inner side end of each first receiving chamber 511, and a second end of the accommodation portion 514 communicates with an inner side end of each second receiving chamber 511*a*. To hang the display box 50 conveniently, the body 51 further includes a hanging portion 515 defined on a top end thereof and being a through slot, a marking portion 516 formed on a predetermined position of the front surface thereof so as to mark at least one of trademark patterns, letters and sizes of each first socket tool 60 and each second socket tool 60*a*; the limiting frame 52 is fixed in the accommodation portion 514 of the body 51 and includes a vertical rod 521 having a plurality of horizontal posts extending outwardly from the vertical rod 521; In this embodiment, the limiting frame 52 is made of flexibly plastic material and includes plural first horizontal posts 522 extending outwardly from a first side thereof corresponding to the plural first receiving chambers 511 of the limiting frame 52, and the limiting frame 52 also includes plural second horizontal posts 522*a* extending outwardly from a second side thereof corresponding to the plural second receiving chambers 511*a* of the limiting frame 52; between the limiting frame 52 and the body 51 is defined a fixing structure for fixing the limiting frame 52 in the accommodation portion 514 of the body 51, and the fixing structure includes at least one flexible retaining portion arranged on the vertical rod 521 of the limiting frame 52, the body 51 includes at least one locking notch for inserting and fixing the at least one flexible retaining portion of the limiting frame 52; in this embodiment, the vertical rod 521 of the limiting frame 52 has a first flexible retaining portion 523 extending outwardly from a first end thereof and a second flexible retaining portion 524 extending outwardly from a second end thereof, and the body 51 further includes a first locking notch 517 and a second locking notch 518 so as to insert and fix the first flexible retaining portion 523 and the second flexible retaining portion 524 of the limiting frame 52. As shown in FIGS. 10 and 11, the body 51 is connected with the limiting frame 52, and since the limiting frame 52 is made of flexibly plastic material, the plural first horizontal posts 522 and the plural second horizontal posts 522*a* of the limiting frame 52 bend and insert into the first socket tools 60 and the second socket tools 60*a*, and an end portion of each first horizontal post 522 of the limiting frame 52 is inserted in the first stopping portion 513 of the body 51 the end portion of each first horizontal post 522, an end portion of each second horizontal post 522*a* of the limiting frame 52 is inserted in the second stopping portion 513*a* of the body 51 so as to stop the end portion of each second horizontal post 522*a*, and the first flexible retaining portion 523 and the second flexible retaining portion 524 of the limiting frame 32 are inserted and fixed in the first locking notch 517 and the second locking notch 518 of the body 51 so that the limiting frame 52 is mounted in the accommodation portion 514 of the body 51, and the display box 50 holds the first socket tools 60 and the second socket tools 60*a* and is hanged hung by ways of the hanging portion 515 of the body 51, thus displaying the socket tools. When the display box 50 is displayed for sale, and a theft is desired to steal the first socket tools 60 and the second socket tools 60*a* by pulling inner end portions of the first socket tools 60 and the second socket tools 60*a*, due to the plural first horizontal posts 522 and the plural second horizontal posts 522*a* of the limiting frame 52 are pressed by the accommodation portion 514 of the body 51, and contacting positions of the inner end portions of the first socket tools 60 and the plural first horizontal post 522 are close to connecting portions of the vertical rod 521 and the plural first horizontal posts 522, and contacting positions of the second socket tools 60*a* and the plural second horizontal posts 522*a* are close to connecting portions of the vertical rod 521 and the plural second horizontal posts 522*a*, so the plural first horizontal posts 522 and the plural second horizontal posts 522*a* of the limiting frame 52 have strong reinforcement to prevent from deformation when they are pulled by the inner end portions of the first socket tools 60 and the second socket tools 60*a*, thus avoiding the first socket tools 60 and the second socket tools 60*a* being removed from the display box 50. In addition, the first stopping portion 513 and the second stopping portion 513*a* of the body 51 stop the end portion of each first horizontal post 522 and each second horizontal post 522*a* of the limiting frame 52, such that outer end portions of each first socket tool 60 and each second socket tool 60*a* are not pulled outwardly, thus obtaining anti-theft purpose. Accordingly, the first socket tools 60 and the second socket tools 60*a* are accommodated in the plural first receiving chambers 511 and the plural second receiving chambers 511*a* of the body 51 by using the plural first horizontal posts 522 and the plural second horizontal posts 522*a* of the limiting frame 52, so not only each first socket tool 60 and each second socket tool 60*a* will not be stolen, but also the limiting frame 52 is hidden on the back surface of the body 51 so as to achieve aesthetics appearance.

Figure 12:
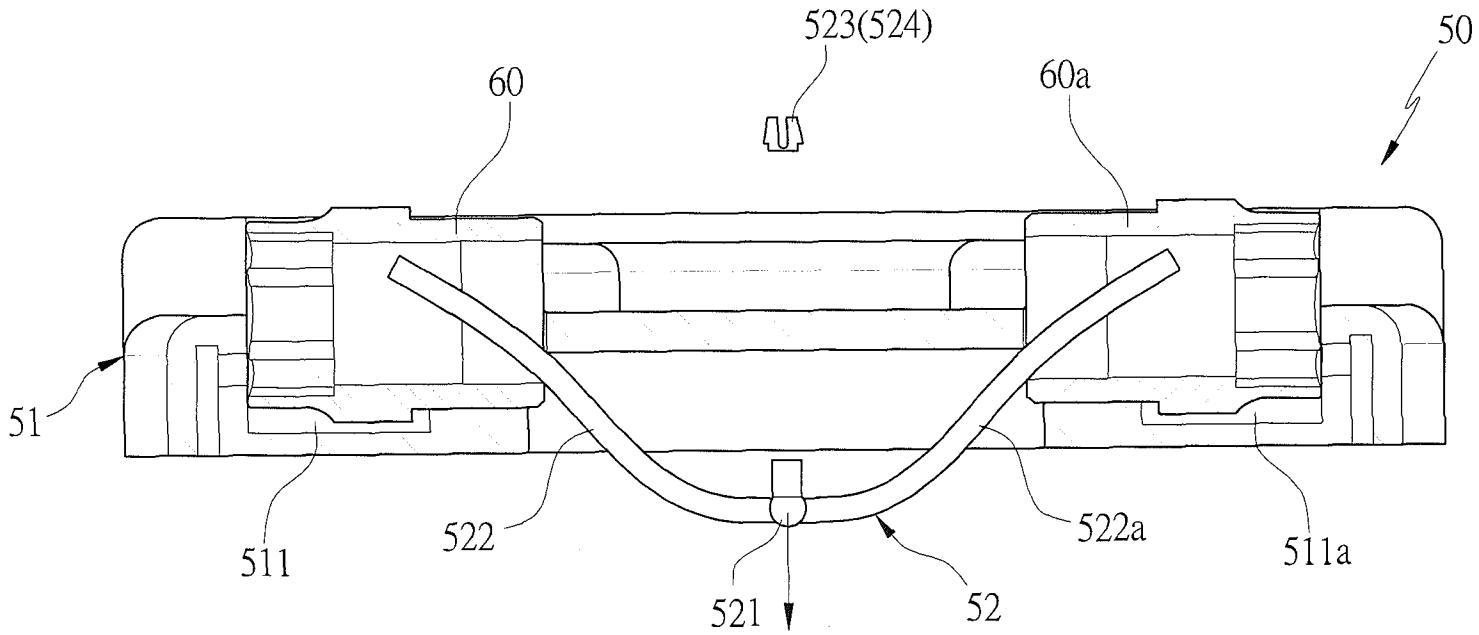
FIG. 12 is a cross sectional view showing the operation of the display box for the socket tools according to the second embodiment of the present invention.

As illustrated in FIG. 12, as intending to remove each first socket tool 60 and each second socket tool 60*a*, the first flexible retaining portion 523 and the second flexible retaining portion 524 of the limiting frame 52 are cut, and then the limiting frame 52 is pulled out of the body 51 so that the plural first horizontal posts 522 and the plural second horizontal posts 522*a* of the limiting frame 52 are separated from the first socket tools 60 and the second socket tools 60*a*, thereby removing the first socket tools 60 and the second socket tools 60*a* from the body 51 easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A display box for sockets comprising:

a body including a plurality of receiving chambers arranged on a front surface thereof so as to accommodate sockets, each receiving chamber having a side fence formed on an outer side end thereof to cover an outer end portion of each socket, the body also including an accommodation portion defined on a back surface thereof and communicating with an inner side end of each receiving chamber;

a limiting frame being fixed in the accommodation portion on the back surface of the body by a fixing structure and including a vertical rod, the vertical rod having a plurality of horizontal posts extending outwardly therefrom so as to abut against the accommodation portion on the back surface of the body, wherein each horizontal post bends and inserts into each socket from the inner side end of each receiving chamber to avoid removing each socket from each receiving chamber on the front surface of the body.

2. The display box for the sockets as claimed in claim 1, wherein the body includes plural first receiving chambers arranged on a first side of the front surface thereof and plural second receiving chambers defined on a second side of the front surface thereof.

3. The display box for the sockets as claimed in claim 2, wherein each first receiving chamber has a first beveled face defined on an inner side end thereof, and each second receiving chamber has a second beveled face formed on an inner side end thereof.

4. The display box for the sockets as claimed in claim 2, wherein the body also includes the accommodation portion defined on a central portion of the back surface thereof, wherein a first side of the accommodation portion communicates with an inner side end of each first receiving chamber, and a second end of the accommodation portion communicates with an inner side end of each second receiving chamber.

5. The display box for the sockets as claimed in claim 2, wherein the limiting frame includes plural first horizontal posts extending outwardly from a first side thereof corresponding to the plural first receiving chambers of the limiting frame, and the limiting frame also includes plural second horizontal posts extending outwardly from a second side thereof corresponding to the plural second receiving chambers of the limiting frame.

6. The display box for the sockets as claimed in claim 1, wherein the fixing structure of the limiting frame includes at least one flexible retaining portion arranged on the vertical rod, and the body includes at least one locking notch for inserting and fixing the at least one flexible retaining portion of the limiting frame.

7. The display box for the sockets as claimed in claim 1, wherein the body further includes a hanging portion defined on a top end thereof.

8. A display box for sockets comprising:

a body including plural first receiving chambers arranged on a first side of a front surface thereof and plural second receiving chambers defined on a second side of the front surface thereof, with the receiving chambers arranged to accommodate sockets, wherein each first receiving chamber has a first side fence formed on an outer side end thereof, wherein each second receiving chamber has a second side fence formed on an outer side end thereof, with the body also including an accommodation portion defined on a back surface thereof and communicating with the receiving chambers; and a limiting frame fixed in the accommodation portion of the body by a fixing structure, with the limiting frame including a vertical rod having plural first horizontal posts extending outwardly from a first side of the limiting frame and corresponding to the plural first receiving chambers and plural second horizontal posts extending outwardly from a second side of the limiting frame and corresponding to the plural second receiving chambers, wherein each first side fence of the body has a first stopping portion for stopping an end portion of a corresponding first horizontal post of the limiting frame, and wherein each second side fence of the body has a second stopping portion for stopping an end portion of a corresponding second horizontal post of the limiting frame.

9. The display box for the sockets as claimed in claim 8, wherein each of the first stopping portion and the second stopping portion is a recess.

* * * * *